US005692645A

United States Patent [19]

Ryu

[11] Patent Number: 5,692,645

[45] Date of Patent: Dec. 2, 1997

[54] FLEXIBLE TUBE DISPENSING APPARATUS

[75] Inventor: Choon Woo Ryu, 2341 W. Cresent Ave., #10, Anaheim, Calif. 92801

[73] Assignee: Choon Woo Ryu, Irvine, Calif.

[21] Appl. No.: 549,409

[22] Filed: Jun. 22, 1995

[51] Int. Cl.[6] ..... B65D 35/28

[52] U.S. Cl. ..... 222/101

[58] Field of Search ..... 222/101

[56] References Cited

U.S. PATENT DOCUMENTS

| | | | |
|---|---|---|---|
| 2,570,755 | 10/1951 | Booth | 222/101 X |
| 2,801,028 | 7/1957 | Ward et al. | 222/101 |
| 2,936,006 | 5/1960 | Henley | 222/101 |
| 3,417,902 | 12/1968 | Mirka | 222/101 X |
| 4,019,655 | 4/1977 | Moeller | 222/101 X |

FOREIGN PATENT DOCUMENTS

| | | | |
|---|---|---|---|
| 1.252.743 | 12/1960 | France | 222/101 |
| 1 220 298 | 1/1971 | United Kingdom | 222/101 |

*Primary Examiner*—Kevin P. Shaver
*Assistant Examiner*—Kenneth Bomberg
*Attorney, Agent, or Firm*—R. Lewis Gable, Esq.; Cowan, Liebowitz & Latman, P.C.

[57] ABSTRACT

In a wall or other vertical surface mounted dispensing apparatus which receives a tube of viscous material has a base which supports a pair of substantially vertical gear tracks for receiving a cylindrical roller which has a plurality of gear teeth about the periphery at each end of the roller for engagement with said gear tracks. The roller is provided with a handle mounted on and axle which is rotatably attached to the roller through end caps which maintain the axle along the central axis of the roller but permit rotation relative to the roller. A cover holds the roller in place by exerting pressure on the cylindrical surface adjacent to the peripheral gears. The axle engages a pair of weights a point offset free the central axis of the weight which cause rotation of the crank arm in the upwards direction when released. A recoil arm mounted on a rectangular section of the axle is displaceable along its longitudinal axis. At the end of said recoil arm opposite said rectangular housing is a pawl for engaging saw tooth edges disposed annularly about the inner periphery of the roller. The operation of the crank arm downward caused a rotation of the roller along the gear track and the resulting pressure on the tube expels the contents of the tube out of a supply tube port which may be selectively sealed and unsealed. When the crank arm is released the weights will cause the crank arm to be moved to a ready position and the dispensing apparatus will be ready for the next operation.

14 Claims, 5 Drawing Sheets

FLEXIBLE TUBE DISPENSING APPARATUS

BACKGROUND OF THE INVENTION

1. Field of the Invention

This invention relates to apparatus for dispensing the contents of a flexible tube holding such contents. More specifically this invention relates to such dispensing apparatus which includes a roller for gradually squeezing the contents of the tube such as toothpaste from the tube.

2. Description of Related Art

The related art is replete with apparatus for dispensing toothpaste and other materials from a flexible tube containing such materials. Typical of such related art is U.S. Pat. No. 2,570,755 to BOOTH, U.S. Pat. No. 2,801,028 to WARD, et. al. and U.S. Pat. No. 3,417,902 to MIRKA. The related art devices which utilize roller type dispensing apparatus are complex in structure and design and require springs and the like for operation, and rubber material to prevent roller retraction.

The instant invention uses no springs but relies on an internal weight driven structure to reset a dispensing handle and to maintain position of the rollers.

SUMMARY OF THE INVENTION

The invention comprises a wall or other vertical surface mounted container having a base which supports a pair of substantially vertical gear tracks curved outward at the top from the wall or other vertical surface. A hollow cylindrical roller is received by said housing which has a plurality of gear teeth spaced about the periphery of the cylinder of the roller and mounted on two annular rings which are fixedly attached to opposite ends of the roller. The thickness of the annular ring causes the cylindrical portion of the roller to be spaced apart from the base when the gear teeth engage the gear tracks. The gear tracks are spaced apart from one another to provide a space for receiving a flexible tube of viscous material such as toothpaste, hair cream, hand lotion and the like. The roller is provided with a crank arm with a handle mounted on an axle which axle extends through the central axis of the roller for rotating the roller. The axle is rotatably mounted in the roller through end caps which have a central hole which maintains the position of the axle along the central axis of the roller but is larger in diameter than the widest part of the axle thereby permitting rotation relative to the roller. A cover for the base holds the roller in place by elongated members which press against the cylindrical surface of the roller.

The crank arm engages the internal structure of the roller which includes a pair of weights mounted on each side of the axle adjacent the inner surface of the end caps such that the axle passes through each of said weights parallel to the longitudinal axis of each weight at a point offset from the central axis of the weight. Together the weights must be of sufficient mass to overcome any internal resistances and cause rotation of the crank arm and handle in the counter clockwise upward direction. Also mounted on said axle between said weights is a recoil arm mounted on a rectangular section of said axle. The recoil arm has a hollow rectangular housing at one end thereof which displaceably engages the rectangular section of the axle thorough the hollow portion of the rectangular housing and is adapted to permit displacement of the recoil arm parallel to its longitudinal axis. At the end of said recoil arm opposite said rectangular housing is a pawl for engaging a plurality of saw tooth edges disposed annularly about the inner periphery of the roller. The recoil arm is of at least sufficient mass such that it will displace in the downward direction when disposed in a substantially vertical direction. A supply tube is provided at the bottom of the dispensing apparatus which has an opening form receiving the top of the flexible tube after the cap has been removed. The tube has a discharge port which is sealed by a snubber rotatably mounted below the supply tube. The snubber has a weight on one end near the vertical surface to which the base is mounted which may be engaged by the hand. The opposite end of the snubber selectively engages the discharge port for alternatively opening and closing the port for dispensing the contents of the tube.

It is an object of this invention to provide a dispensing apparatus 1 which does not require springs.

It is another object of this invention to provide a dispensing apparatus which utilizes gravity to reset its operational mechanism.

It is still another object of his invention to provide a dispensing apparatus which utilizes gravity for sealing the dispenser when the same is not in use.

DESCRIPTION OF THE PREFERRED EMBODIMENTS(S)

Figure 1:
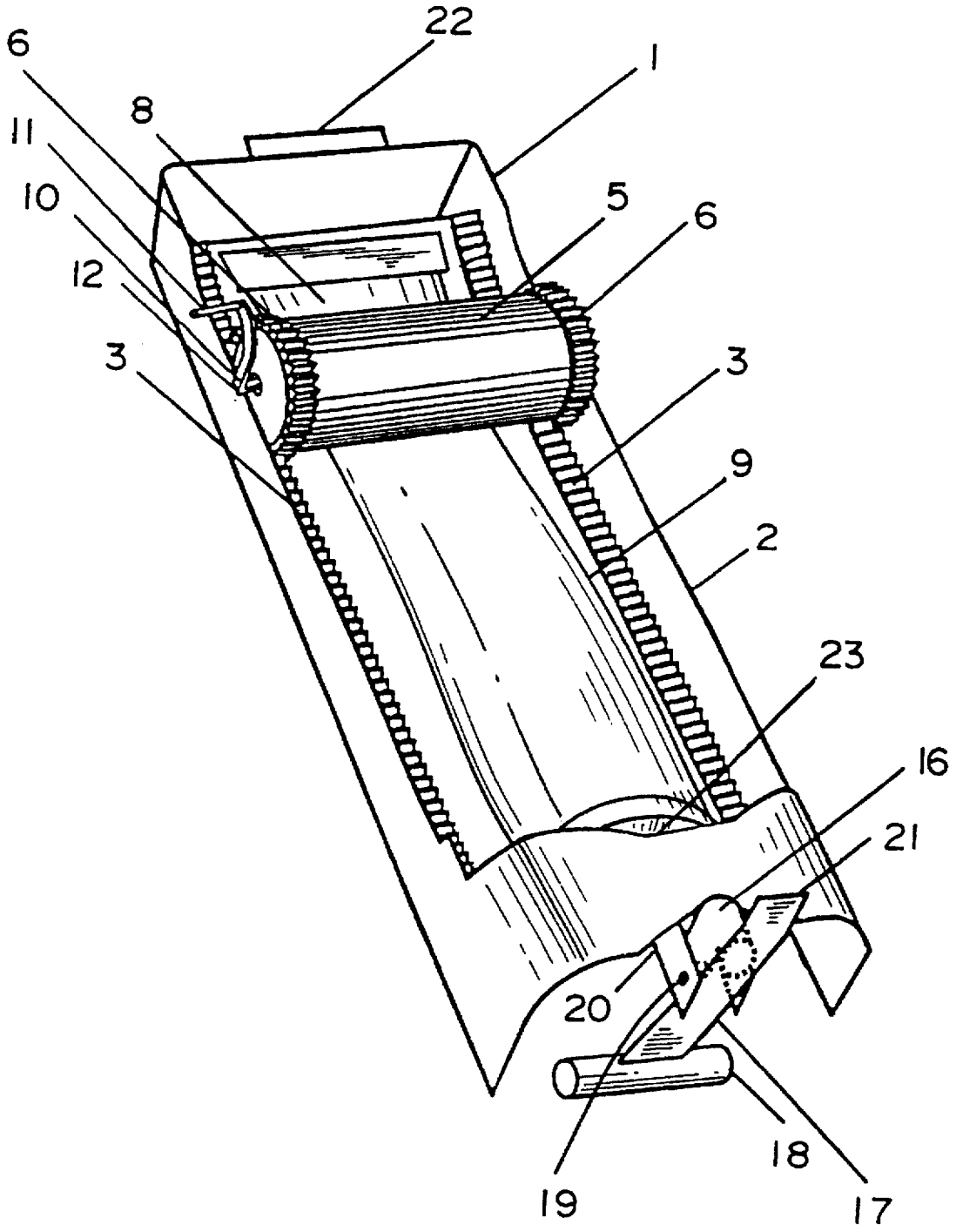
FIG. 1 is a perspective view of the housing showing the roller in position over a flexible tube and engaging the gear tracks.
Figure 2:
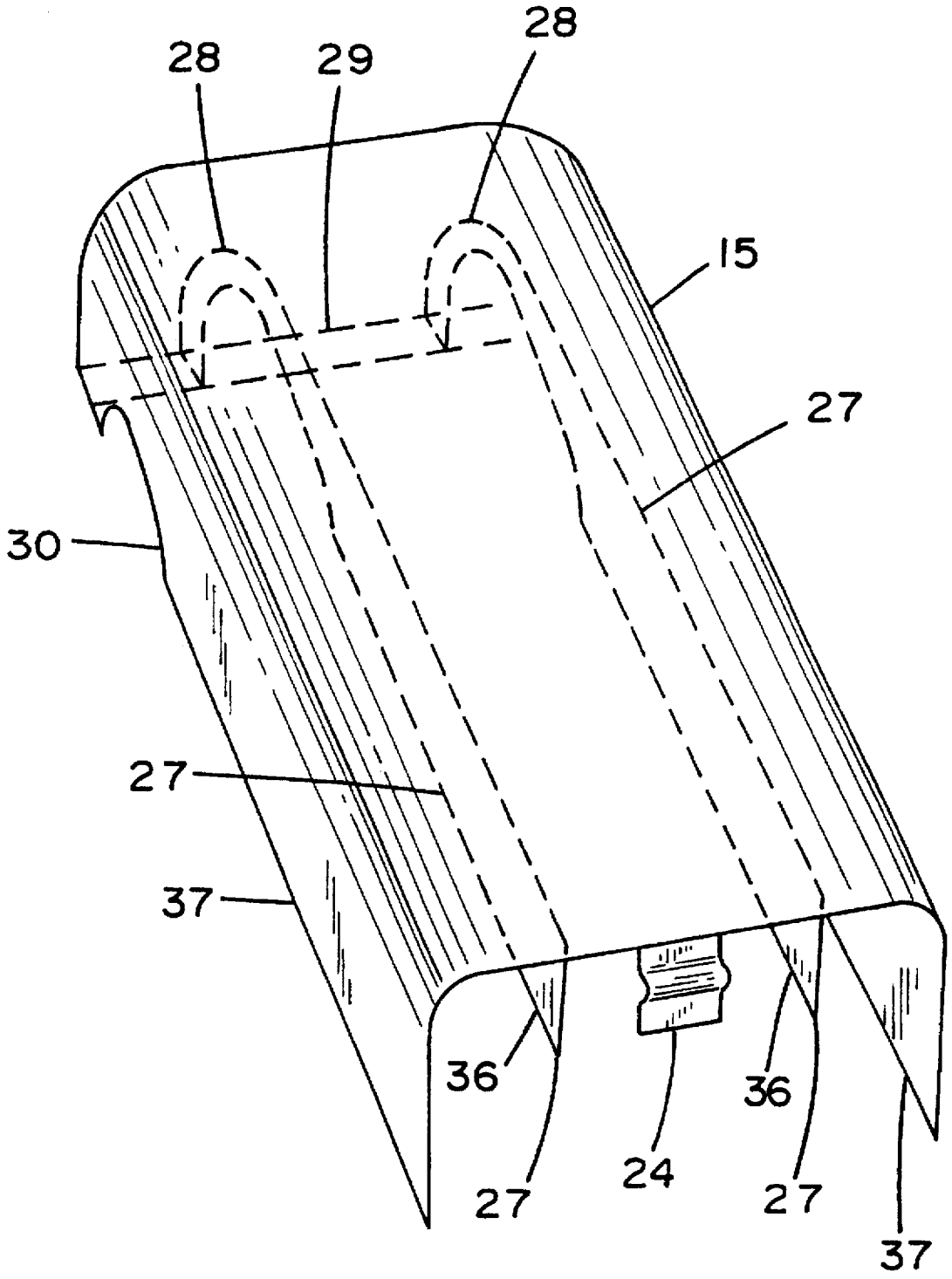
FIG. 2 is a perspective view of cover.

With reference to Figures. FIG. 1, shows the dispensing apparatus 1 with having a base 2 which supports a pair of substantially vertical gear tracks 3 curved outward from the wall or other vertical surface 4 at the top. A hollow cylindrical roller 5 is received by said housing which has a plurality of gear teeth 6 spaced about the periphery of the cylinder 8 of the roller 5 and mounted on two annular rings 7 integral with said gear teeth 6 which are fixedly attached to apposite ends of the roller 5. The thickness of the annular rings 7 causes the cylinder 8 of the roller 5 to be spaced apart from the base 2 when the gear teeth 6 engage the gear tracks 3. The gear tracks 3 are spaced apart from one another to provide a space for receiving a flexible babe 9 of viscous material such as toothpaste, hair cream, hand lotion and the like. The roller 5 is provided with a crank arm 10 having a handle 11 mounted on and axle 12 which axle 12 extends through the central axis of the roller 5 for rotating the roller 5. The top of the base 2 has a tab 22 for holding a lip 29 of the cover 15 as shown in FIG. 2. The bottom of the base 2 has an edge 23 for receiving a locking tab 24 of the cover 15 such that when the cover 15 is placed over the upper tab 22, it may be snapped into place with locking tab 24 and held in place with sufficient force as to prevent the roller 5 from dislodging when in operation. The bottom of the base 2 also has a pair of support arms, 20 which support a snubber 17 having a trunnion 19 on each side thereof to permit articulation of the snubber 17 thereby permitting rotational movement about the axis of each trunnion 19. The snubber 17 has a snubber weight 18 at one end which due to the force of gravity causes the opposite end of the snubber 17 to rotate against a supply tube 16 port 39 attached to the support arms 20 mounted in the base 2. The end of the snubber 17 which is in contact with the supply tube 16 port 39 is flat and disposed so that the surface thereof cover 15 the opening of the port 39, however, depending on the viscosity of the contents of the flexible tube 9 it my include a rubber stopper or equivalent device to insure a better seal. The current embodiment uses toothpaste and a stopper is not necessary. The supply tube 16 is adapted to receive the top of the flexible tube 9 and permits the contents of the flexible tube 9 to be discharged through the supply tube port 39 when the handle 11 is pulled downward. If greater sealing is required due to different viscosities the supply tube 16 may made removable and provided with screw threads to match the flexible tube 9 opening and attached to the flexible tub prior to insertion of supply tube 16 into the dispensing apparatus 1.

The vanes 27 have a curved section 28 at the top to accommodate the roller 5 and the bottom surface 36 is substantially equidistant from the gear tracks 3 along most of its length. The resistance of the bottom of the vanes 27 against the roller 5 ensures that the peripheral gears of the roller 5 will remain engaged with the gear track.

Since the gear track is curved these vanes 27 also have a curved section, such vanes 27 are positioned adjacent to the peripheral gears and spaced apart therefrom. The vanes 27 are fixedly attached to the cover 15. Other structures can be used to maintain the roller 5 in position such as a U shaped structure or an elongated solid rectangular member or other shape and are considered within the scope of this invention.

FIG. 2 shows the cover 15 having a pair of elongated vanes 27 fixedly attached to the underside of the cover 15. A slot 30 is also provided on the bottom surface of the cover 15 to permit the axle 12 to extend out of the side of the base 2 and cover 15 for attachment of the crank arm 10 and handle 11. When installed the bottom surface of the cover 15 remains spaced apart from the base 2 to allow the axle 12 to pass below it.

Figure 3:
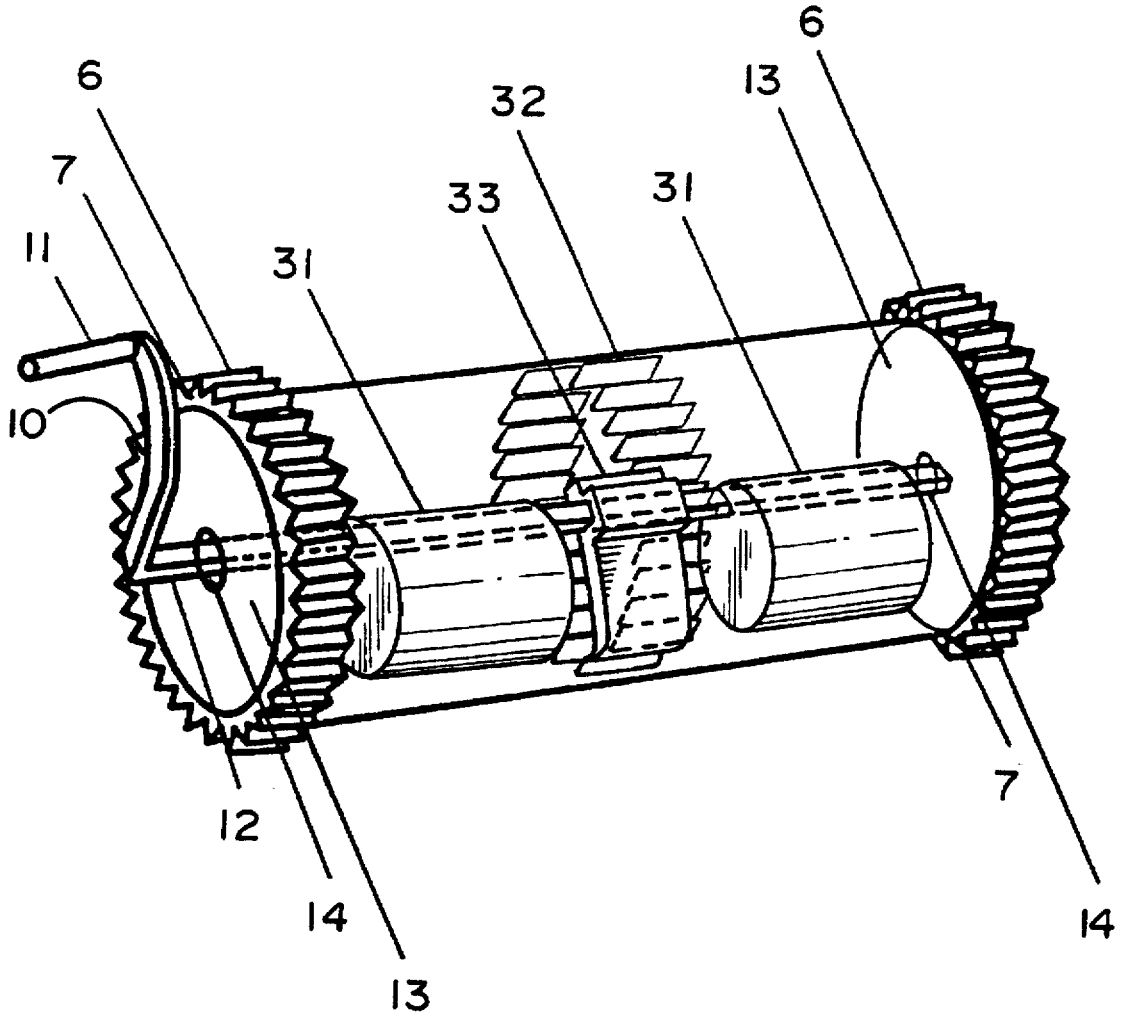
FIG. 3 is a perspective view of the roller showing the internal structure.

As shown in FIG. 3, the axle 12 is rotatably mounted in the roller 5 through end cap 13 which have a central hole 14 which maintains the position of the axle 12 along the central axis of the roller 5. The diameter hole 14 is larger than the greatest dimension of the axle 12 thereby permitting rotation relative to the roller 5. Although not necessary due to the minimal stresses involved, this axle 12 may be mounted for such rotation relative to the roller 5 through a nylon, plastic, or other bushing or bearing or in any other convenient way as is well known.

FIG. 3 shows engagement of the handle 11 and crank arm 10 with the internal structure of the roller 5 which includes a pair of axle weights 31 which are mounted on each end of the axle 12 adjacent the inner surface of the end caps 13 such that the axle 12 passes through each of said axle weights 31 at a point offset from the center of gravity of the axle weights 31. Together the axle weights 31 must be sufficient to overcome any internal resistances and cause rotation of the crank arm 10 in the upwards direction when the handle 11 is released. Also mounted on said axle 12 between said axle weights 31 is a recoil arm 33 mounted on a rectangular section of said axle 12.

Figure 4:
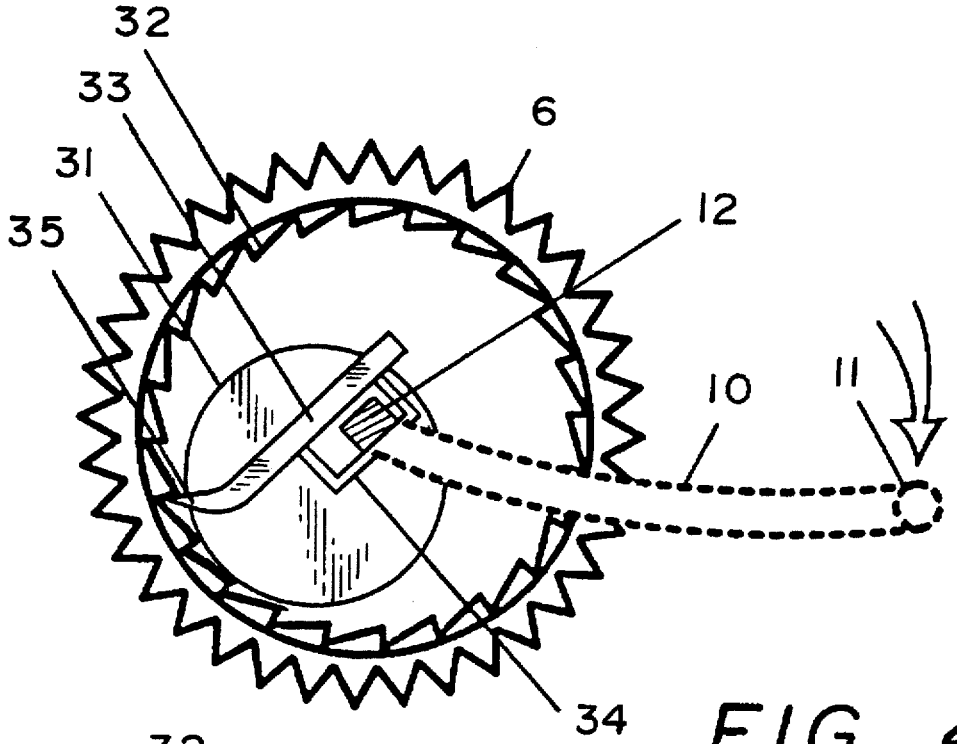
FIG. 4 is a view of the inside of the roller in operation.
Figure 5:
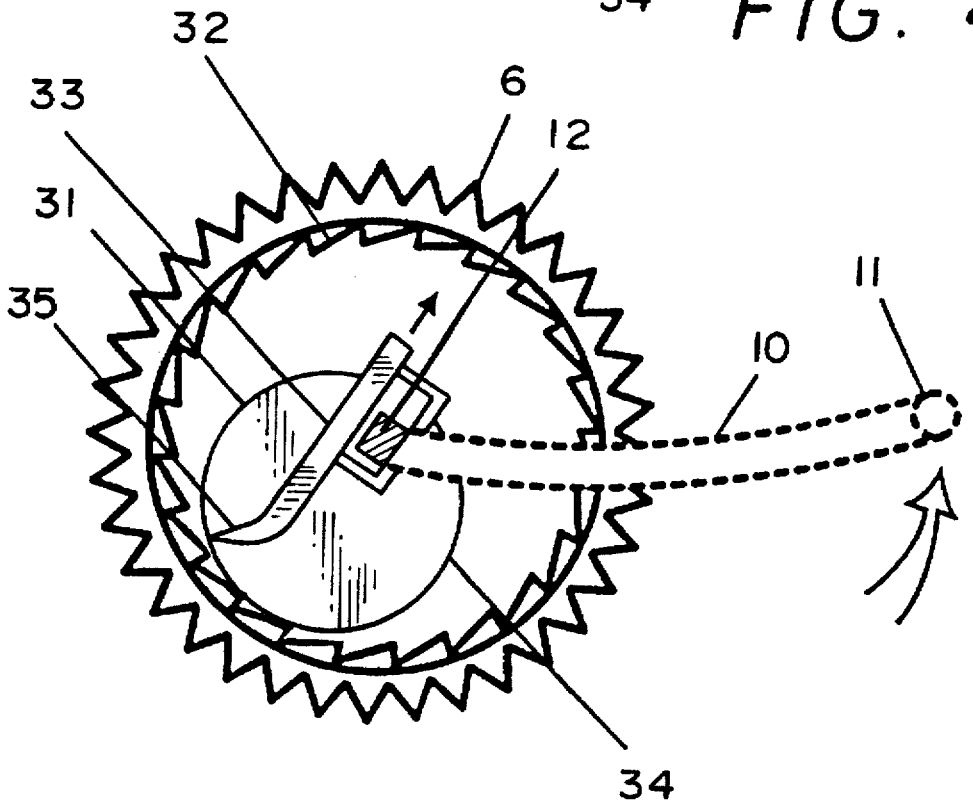
FIG. 5 is a view of the inside of the roller resetting to the starting position.

The operation of the internal elements of the roller 5 can be determined with reference to FIGS. 4 and 5, the recoil arm 33 has a hollow rectangular housing 34 at one end thereof which displaceably engages the rectangular section of the axle 12 through the hollow portion of the rectangular housing 34 and is adapted to permit displacement of the recoil arm 33 parallel to its longitudinal axis. At the end of said recoil arm 33 opposite said rectangular housing 34 is a pawl 35 for engaging a plurality of saw tooth edges 32 disposed annularly about the inner periphery of the roller 5. The recoil arm 33 is of at least sufficient mass that it will displace in the downward direction when oriented in a substantially vertical direction. FIG. 4 shows the crank arm 10 being pulled down. Ibis causes the recoil arm 33 to engaged the saw tooth edges 32 and locking the rotational movement of the axle 12 to the roller 5. This will cause the roller 5 to rotate and traverse downward along the gear tracks 3. FIG. 5 shows the action of the axle weights 31 on release of the handle 11. The axle weights 31 cause the axle 12 to rotate and the handle 11 moves upward at the same time the recoil arm 33 is dragged in a direction away from the locking edge of the saw tooth edges 32 and along the inclined edges of the saw tooth edges 32. The recoil arm 33 will displace in a reciprocal fashion along a path parallel to its longitudinal axis until the axle weights 31 have rotated the internal structure to the lowest point of relative potential energy. That is, when the recoil arm 33 is substantially vertical.

Figure 6:
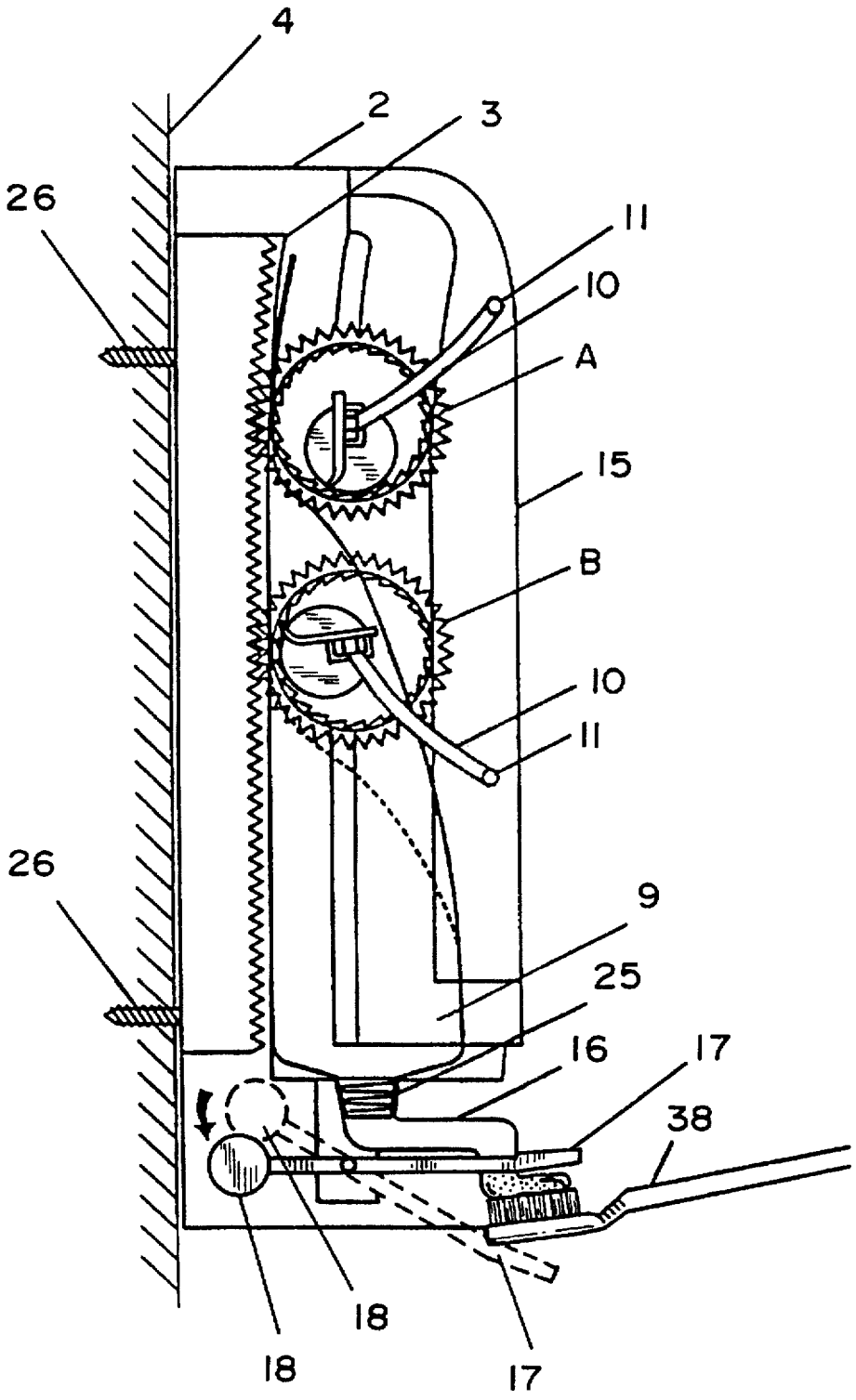
FIG. 6 is a side view of the dispensing apparatus showing the roller in a starting position and in a dispensing position.

FIG. 6 is a side view of the dispensing apparatus 1, mounted on a wall or other vertical surface 4 by screws 26 or other similar fastening devices. In this example, the snubber weight 18 of the snubber 17 is pushed upward which causes the opposite end of the snubber 17 to rotate downward opening the supply tube port 39 and a tooth brush 38 is position under the supply tube 16 port 39. The handle 11 is pulled down force a position A and the roller 5 structure and handle 11 move to a position B which causes the pawl 35 of the recoil arm 33 to lock into the saw tooth edges 32. This in turn will cause the roller 5 to rotate and pass over the surface of the flexible tube 9 compressing the same causing the contents of the flexible tube 9 to be expelled out of the supply tube port 39.

In operation the dispensing apparatus 1 is removed from the vertical surface 4 and placed on a substantially horizontal surface. A flexible tube 9 of viscous material with the top removed is placed in the housing in the space between the gear tracks 3 ensuring that the top of the tube is inserted into a supply tube 16 adapted for receiving the top of said flexible tube 9. The roller 5 is placed at the top of the dispensing apparatus 1 with the peripheral gear teeth 6 in engagement with the upper teeth of the gear tracks 3. The cover 15 is then replaced by hooking the lip 29 over the upper mounting tab 22 at the top of the base 1 and snapped into place with the locking tab 24 at the bottom which engages a locking tab surface 23 of the base 2. When the dispensing apparatus 1 is remounted on the wall or other vertical surface 4, the crank arm 10 and handle 11 will automatically adjust into the ready position by action of the axle weights 31. This repositions the recoil arm 33 to a vertical position and gravity will cause the recoil arm 33 to displace downward. When displaced downward the pawl 35 of the recoil arm 33 to engage the inner annular saw tooth edges 32. When the contents of the flexible tube are desired, one may pull down on the handle 11 as discussed above and the material to be dispensed will then be expelled through the supply tube 16 port 39 into the hand or on a tooth brush 38. When the hand or brush is removed the supply tube 16 discharge port 39 will be sealed by rotation of the snubber 17 to the closed position by action of the snubber weight 18 and the dispensing apparatus 1 will be ready for the next operation.

Having thus described the invention what is claimed is:

1. A dispensing apparatus for dispensing the contents of at least one flexible tube containing a viscous substance and including an opening, said dispensing apparatus comprising:

a. a base having at least two gear tracks spaced apart to provide a space for receiving the tube, b. means for supplying the contents of the tube adapted for communication with the opening of the tube, c. a hollow cylindrical roller having a plurality of annular rings attached thereto, at least two of said plurality of annular rings are disposed on opposite sides of said space for said tube, each of said two annular rings has a plurality of gear teeth disposed about the periphery of its annular ring for engaging a corresponding one of said two gear tracks, said roller having an axis, a radius, and inside and outside surfaces, d. an axle rotatably engaging said roller, e. at least one end cap for said roller having a hole in the center thereof for receiving said axle and maintaining said axle in a position parallel to said axis of said roller, said hole adapted for permitting rotation of said axle relative to said roller, f. a plurality of saw tooth edges spaced annularly about said inside surface of said roller, each such edge having one side which lies along a plane parallel to said radius of said roller and one said which is slanted away from said inside surface of said roller towards said axle, g. a recoil arm having a longitudinal axis and displaceably mounted on said axle for displacement along a path substantially parallel with said longitudinal axis of said recoil arm, said recoil arm having a pawl on one end for selectively engaging one of said saw tooth edges, h. at least one weight having a center of gravity and disposed inside said roller and fixedly attached to said axle at a point remote from said center of gravity and adapted to adjust to a position which aligns said center of gravity and the point of attachment to said axle along a substantially vertical line, and i. a cover which is removably mounted on said base having a plurality of vanes attached to one side thereof for slidably engaging said outside surface of said roller, each of said vanes spaced equidistant from said gear teeth along at least a portion of said vanes for holding said gear teeth of said roller in communication with said two gear tracks of said base:

whereby rotation of said axle in a direction which engages the pawl with said saw tooth edges will cause said roller to rotate and whereby release of said axle will allow said weights to rotate said axle in the opposite direction and reset said recoil arm to another saw tooth edge.

2. A dispensing apparatus for dispensing the contents of at least one flexible tube having an opening and containing a viscous substance, said dispensing apparatus comprising:

a. a base having a plurality of gear tracks spaced apart to provide a space for receiving the tube, b. means for supplying the contents of the tube adapted for communication with the opening of the tube, c. means for applying compression to the tube, said means including gear teeth for engaging said gear tracks and an axis, d. a cover removably engaging said base, said cover including means for holding said compression means against said base when said cover engages said base such that said gear teeth of said compression means are in communication with said gear tracks of said base, and e. means for selectively rotating said compression means about said axis only in a first direction whereby said gear teeth engage said gear tracks to advance said compression means along said gear tracks to apply compression to the tube and dispense the contents from the tube, said rotating means including an arm and being mounted for reciprocal rotation in said first direction while said arm engages and rotates said compression means therewith in said first direction and in a second direction opposite to said first direction while said arm disengages said compression means and said compression means remains relatively stationary, said rotating means being manually graspable to be manually driven in said first direction.

3. Dispensing apparatus as claimed in claim 2, wherein said rotating means comprises means for automatically driving said compression means in said second direction when said rotating means is manually released.

4. Dispensing apparatus as claimed in claim 2, wherein said rotating means comprises an axle, a manually graspable handle affixed to said axle to rotate said axle in said first direction, a roller for engaging and compressing the tube, said roller adapted to be freely rotated with respect to said axle, and means for mounting said arm to said axle to engage said roller when rotated in said first direction and to disengage said roller when rotated in said second direction.

5. Dispensing apparatus as claimed in claim 4, wherein said roller has an axis, a plurality of annular rings attached thereto, a radius and inside and outside surfaces, at least two of said plurality of annular rings are disposed on opposite sides of said space for the tube, each of said two annular rings having said gear teeth disposed about the periphery of said annular rings for engaging said gear tracks.

6. Dispensing apparatus as claimed in claim 5, wherein said roller further includes at least one end cap having a hole in the center thereof for receiving said axle and maintaining said axle in a position parallel to said axis of said roller, said hole adapted for permitting rotation of said axle relative to said roller.

7. Dispensing apparatus as claimed in claim 6, wherein a plurality of saw tooth edges are spaced annularly about said inside surface of said roller, each such edge having one side which lies along a plane parallel to said radius of said roller and one side which is slanted away from said inside surface of said roller toward said axle.

8. Dispensing apparatus as claimed in claim 7, wherein said arm has a longitudinal axis and is displaceably mounted on said axle for displacement along a path substantially parallel with said longitudinal axis of said arm, said arm having a pawl on one end for selectively engaging one of said saw tooth edges.

9. Dispensing apparatus as claimed in claim 8, wherein rotating means further includes at least one weight having a center of gravity, being disposed inside of said roller and being fixedly attached to said axle at a point remote from said center of gravity, said weight being adapted to adjust to a position which aligns said center of gravity and said point of attachment to said axle along a substantially vertical line.

10. Dispensing apparatus as claimed in claim 4, wherein said arm mounting means mounts said arm for movement between a first position wherein said arm engages from said roller and a second position wherein said arm disengages from said roller, said mounting means responsive to the rotation of said axle in said first direction to move said arm to said first position and to the rotation of said axle in said second direction to move said arm to said second position.

11. Dispensing apparatus as claimed in claim 10, wherein said roller has an inside surface and a plurality of saw tooth edges spaced annularly about said inside surface, said mounting means disposes said arm in said first position wherein said arm engages one of said plurality of saw tooth edges to rotate said roller in said first direction and is responsive to the rotation of said axle in said second direction to move said arm to said second position wherein said arm disengages from said plurality of saw tooth edges.

12. Dispensing apparatus as claimed in claim 2, wherein said rotating means comprises means for automatically driving said compression means in said second direction when said rotating mean is manually released.

13. Dispensing apparatus as claimed in claim 12, wherein said rotating means comprises an axle and a roller for engaging and compressing the tube and mounted with respect to said axle to freely rotate there about, said automatic driving means comprises at least one weight suspended from said axle for automatically driving said compression means in said second direction.

14. Dispensing apparatus as claimed in claim 13, wherein said one weight has a center of gravity and is disposed inside of said roller and fixedly attached to said axle at a point remote from said center of gravity and adapted to adjust to a position which aligns said center of gravity and said point of attachment to said axle along a substantially vertical line.

* * * * *